US006558203B2

(12) United States Patent
Pocrass

(10) Patent No.: US 6,558,203 B2
(45) Date of Patent: May 6, 2003

(54) MULTI-FUNCTION RJ-TYPE MODULAR CONNECTOR

(76) Inventor: Alan L. Pocrass, 41 Golden Glen, Simi Valley, CA (US) 93065

( * ) Notice: Subject to any disclaimer, the term of this patent is extended or adjusted under 35 U.S.C. 154(b) by 114 days.

(21) Appl. No.: 09/902,448

(22) Filed: Jul. 10, 2001

(65) Prior Publication Data

US 2003/0013347 A1 Jan. 16, 2003

(51) Int. Cl.[7] ..... H01R 24/00
(52) U.S. Cl. ..... 439/676; 439/218
(58) Field of Search ..... 439/676, 218, 439/217, 221–224

(56) References Cited

U.S. PATENT DOCUMENTS

| | | | | |
|---|---|---|---|---|
| 3,523,269 A | | 8/1970 | Witek, Jr. et al. | |
| 4,379,606 A | | 4/1983 | Clark et al. | |
| 4,457,570 A | | 7/1984 | Bogtese, II | |
| 4,648,682 A | | 3/1987 | Tubbs | |
| 4,873,479 A | * | 10/1989 | Iimura et al. | 439/218 |
| 4,978,317 A | | 12/1990 | Pocrass | |
| 5,501,608 A | * | 3/1996 | Scheer et al. | 439/218 |
| 5,605,473 A | | 2/1997 | Kishon | |
| 6,027,365 A | * | 2/2000 | Kaufman | 439/218 |
| 6,116,963 A | * | 9/2000 | Shutter | 439/676 |
| 6,183,306 B1 | * | 2/2001 | Caveney | 439/676 |
| 6,190,190 B1 | * | 2/2001 | Daly et al. | 439/218 |
| 6,193,560 B1 | * | 2/2001 | Morana et al. | 439/676 |
| 6,210,236 B1 | * | 4/2001 | Kan | 439/676 |
| 6,290,538 B1 | | 9/2001 | Pocrass | |

* cited by examiner

*Primary Examiner*—Gary F. Paumen
(74) *Attorney, Agent, or Firm*—Webb Ziesenheim Logsdon Orkin & Hanson, P.C.

(57) ABSTRACT

A multi-purpose modular connector having a female housing and a male plug, the female housing defining an open end, a first internal cavity, four interior surfaces, an interior end surface a first contact terminal positioned adjacent to at least one of the four interior surfaces, and a second contact terminal positioned adjacent to any remaining one of the four interior surfaces.

23 Claims, 8 Drawing Sheets

MULTI-FUNCTION RJ-TYPE MODULAR CONNECTOR

BACKGROUND OF THE INVENTION

1. Field of the Invention

The present invention generally relates to modular connectors having a female housing and a removable male plug and, more particularly, to multi-purpose modular connectors.

2. Brief Description of the Prior Art

RJ-type modular connectors generally include an RJ-type female housing configured to releasably receive an RJ-type male plug. RJ-type modular connectors are commonly used in conjunction with electronic telecommunications, data networking equipment, and computers. The female housing is generally a hollow box which defines a first internal cavity and four interior surfaces. A latch groove is generally defined adjacent to one of the four interior surfaces. A plurality of contact terminals is positioned inside the first interior cavity, adjacent to one of the four interior surfaces and preferably opposite the interior surface defining a latch groove. Each of the contact terminals is electrically connected to a corresponding phone line, wire, printed circuit board lead, or some other system or device. One RJ-type modular connector is described in U.S. Pat. No. 4,978,317 to Pocrass, herein incorporated by reference in its entirety.

The first internal cavity of the female housing receives the male plug. The male plug is generally box-shaped and defines four external surfaces, an open end, a closed end, and usually a second internal cavity. One of the four external surfaces defines a plurality of partitioned wire grooves, wherein the open end, second internal cavity, and each of the plurality of partitioned wire grooves are connected to one another. A collapsible wire holder may be defined by any one of the four external surfaces, and a flexible latch is usually positioned adjacent to the external surface positioned opposite to the external surface defining the plurality of partitioned wire grooves.

In one typical configuration, a plurality of wires is inserted into the open end of the male plug. One end of each of the plurality of individual wires is positioned in a corresponding one of the plurality of partitioned wire grooves. The collapsible wire holder is then compressed to hold each of the plurality of individual wires securely within the male plug. The male plug is then inserted into the female housing, such that a ridge on the flexible latch releasably seats in the latch groove, and each of the plurality of individual wires contacts a corresponding one of the plurality of contact terminals. The other end of each of the plurality of individual wires may also be individually connected to another male plug in the same manner described above, forming a plurality of individual wires having a housing at both ends.

A significant limitation of prior art RJ-type modular connectors is that the modular connectors are dedicated to one particular function. For example, RJ11 modular connectors are often used in telecommunication applications. RJ11 female housings generally include up to six separate contact terminals, with a corresponding number of male plug partitioned wire grooves. In data networking applications, an RJ45 modular connector is often used. The RJ45 modular connectors generally include up to eight separate contact terminals, with a corresponding number of male partitioned wire grooves, and are specially designed for Local Area Network (LAN) or ETHERNET connectivity. Therefore, if both telecommunication modem and networking capabilities are desired in one particular type of device, such as a computer, the device is generally configured with at least one RJ11 modular connector and at least one RJ45 modular connector. The need for at least two different types of modular connectors increases the size of the device, which is an unwanted design limitation, particularly in the hand-held or laptop computer markets.

SUMMARY OF THE INVENTION

To help ease the limitations currently imposed by the prior art, the present invention generally includes an RJ-type modular connector which includes an RJ-type female housing and an RJ-type male plug. The RJ-type female housing is configured to receive the RJ-type male plug. The RJ-type female housing has an open, plug receiving end and least two interior surfaces. A first RJ-type contact terminal configuration is positioned along one of the interior surfaces, and a second RJ-type contact terminal configuration is positioned along another interior surface, wherein the second RJ-type contact terminal configuration has a different configuration than the first RJ-type contact terminal configuration, and the first and second contact terminal configurations are adapted to selectively mate with the RJ-type male plug when the plug is oriented with respect to the first and second contact terminals.

These and other advantages of the present invention will be clarified in the description of the preferred embodiment taken together with the attached drawings in which like reference numerals represent like elements throughout.

DETAILED DESCRIPTION OF THE PREFERRED EMBODIMENTS

Figure 4:
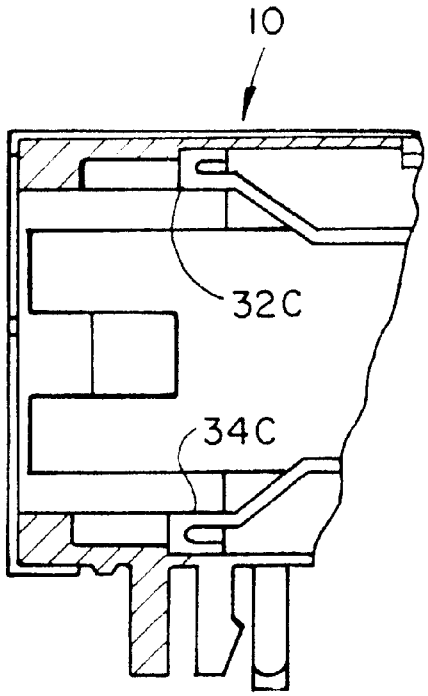
FIG. 4 is a partial cross-sectional side view of the female housing shown in FIG. 1, taken along section line I—I, with another type of contact terminal.
Figure 5:
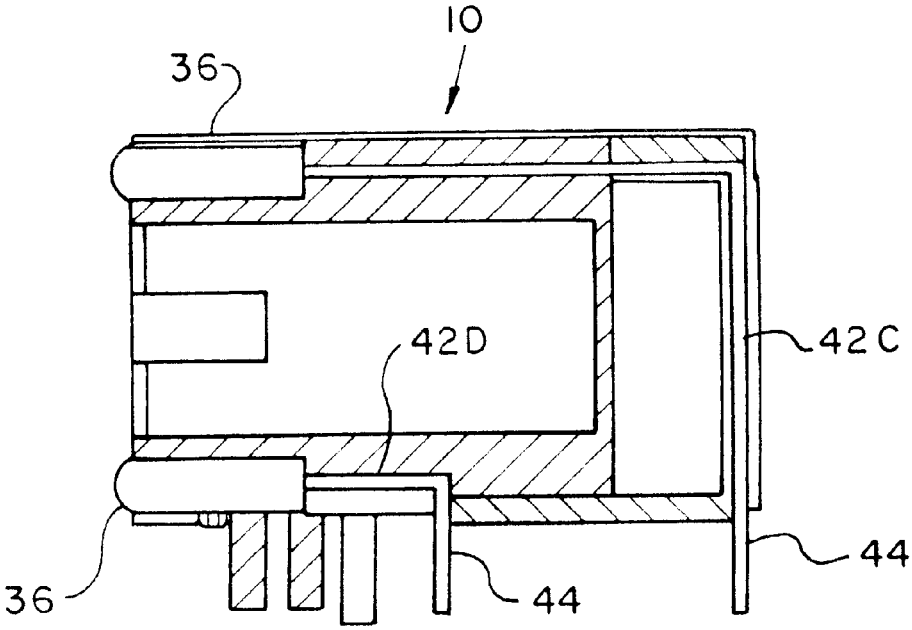
FIG. 5 is a cross-sectional side view of the female housing shown in FIG. 1, taken along section line II—II.
Figure 6:
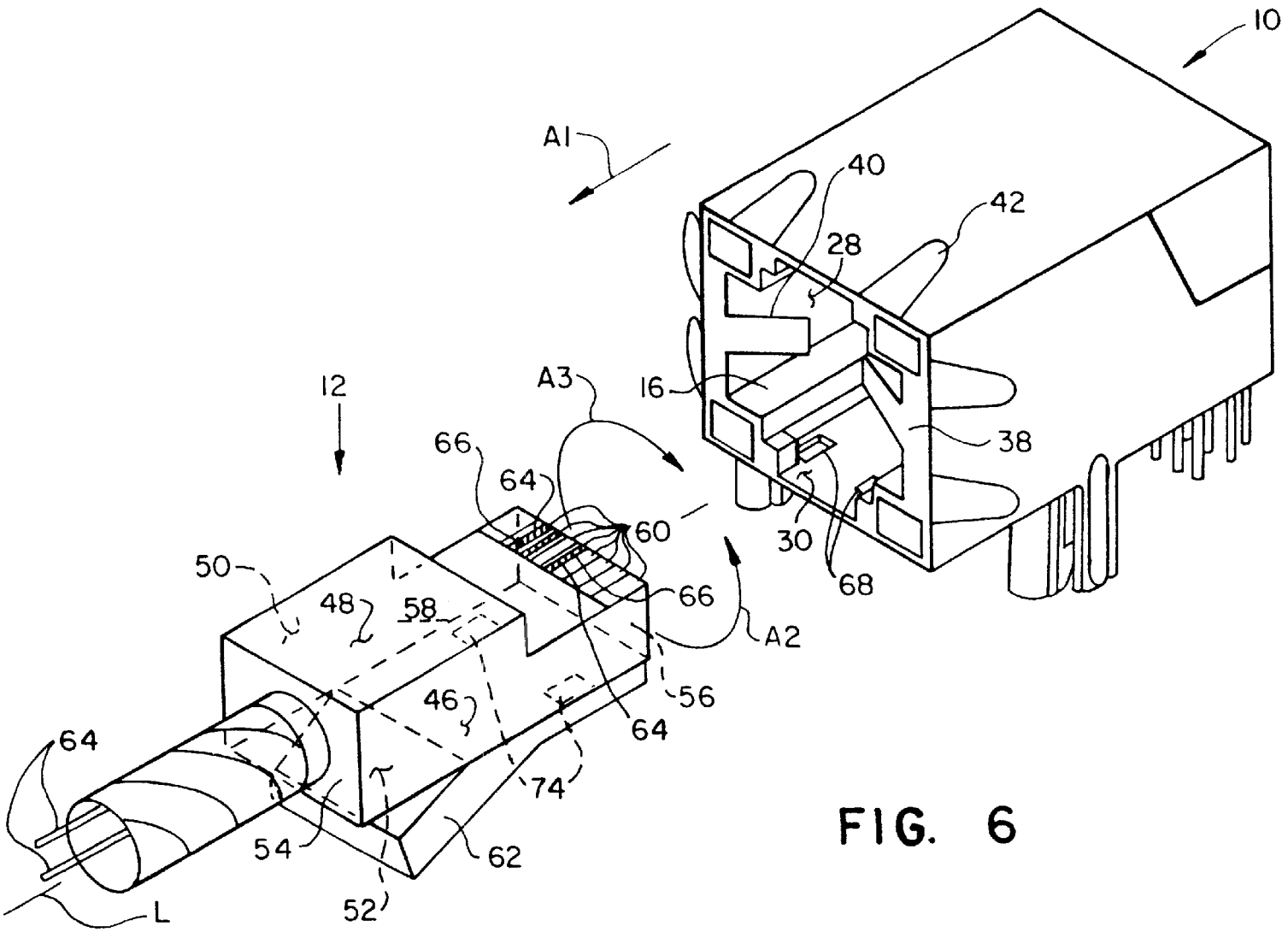
FIG. 6 is a perspective view of the female housing shown in FIG. 1 and a first embodiment male plug according to the present invention.
Figure 7:
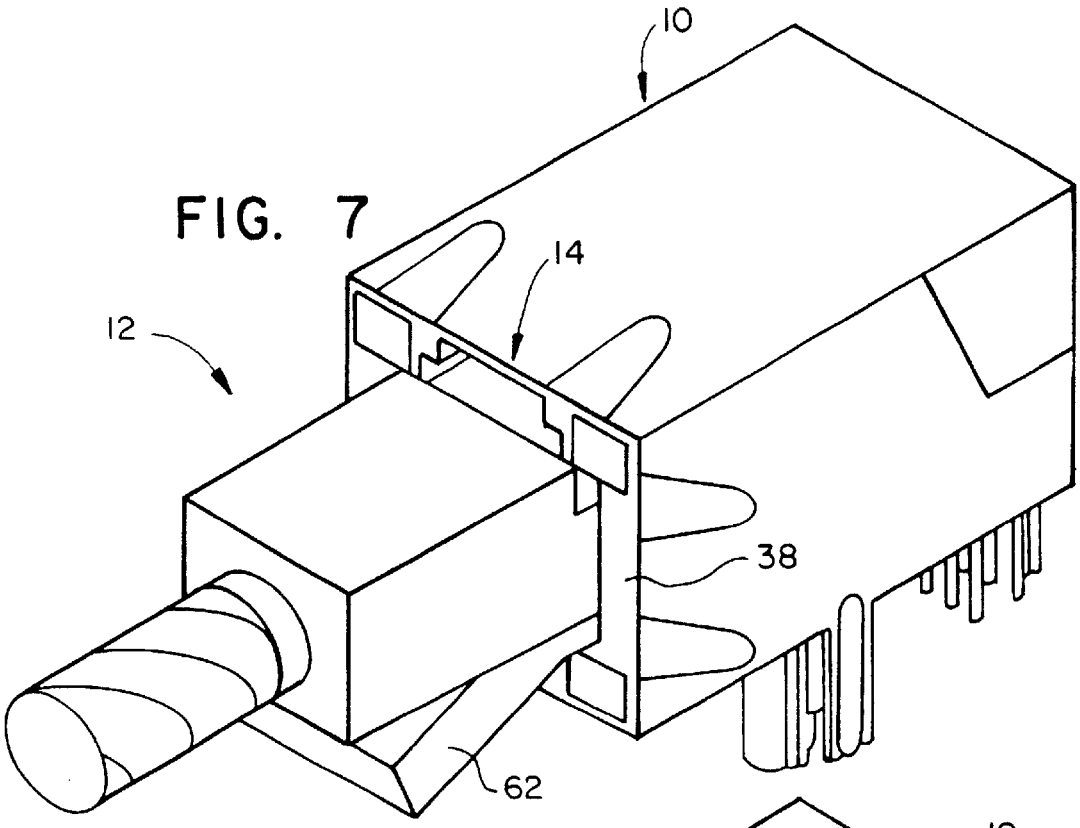
FIG. 7 is a perspective view of the female and male plugs shown in FIG. 6 connected in a first orientation.
Figure 8:
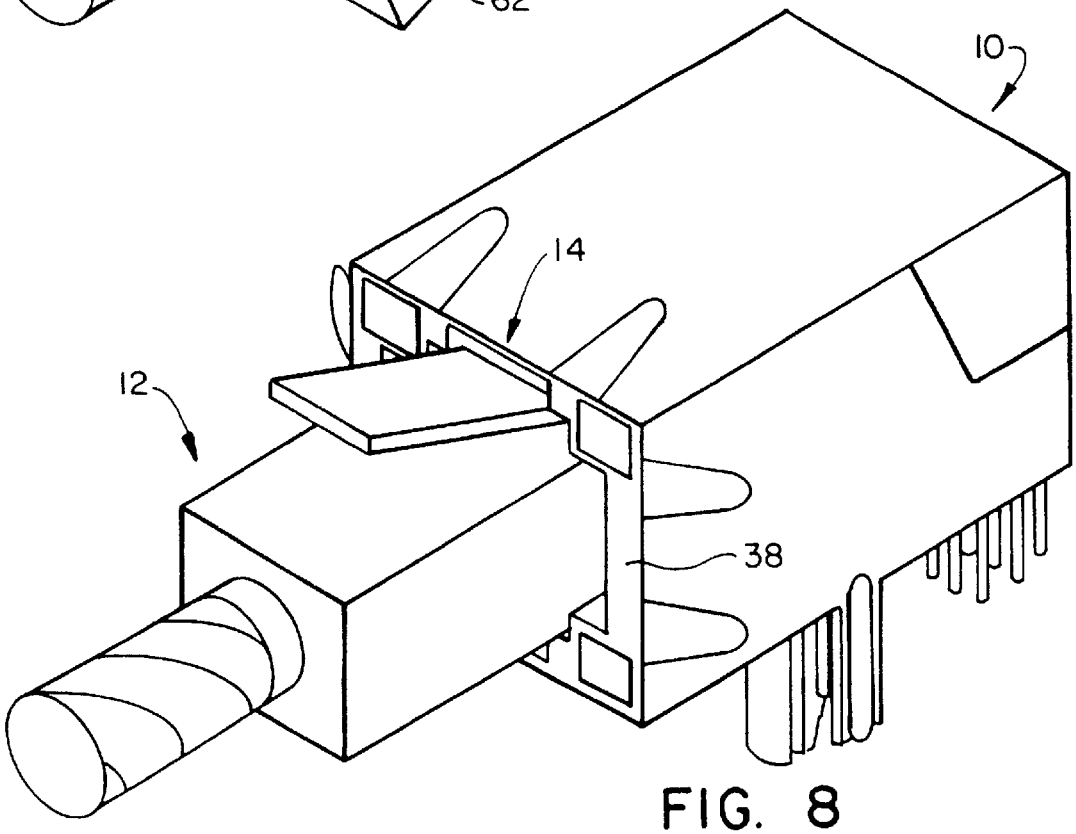
FIG. 8 is a perspective view of the female and male plugs shown in FIGS. 6–7 connected in a second orientation.
Figure 9:
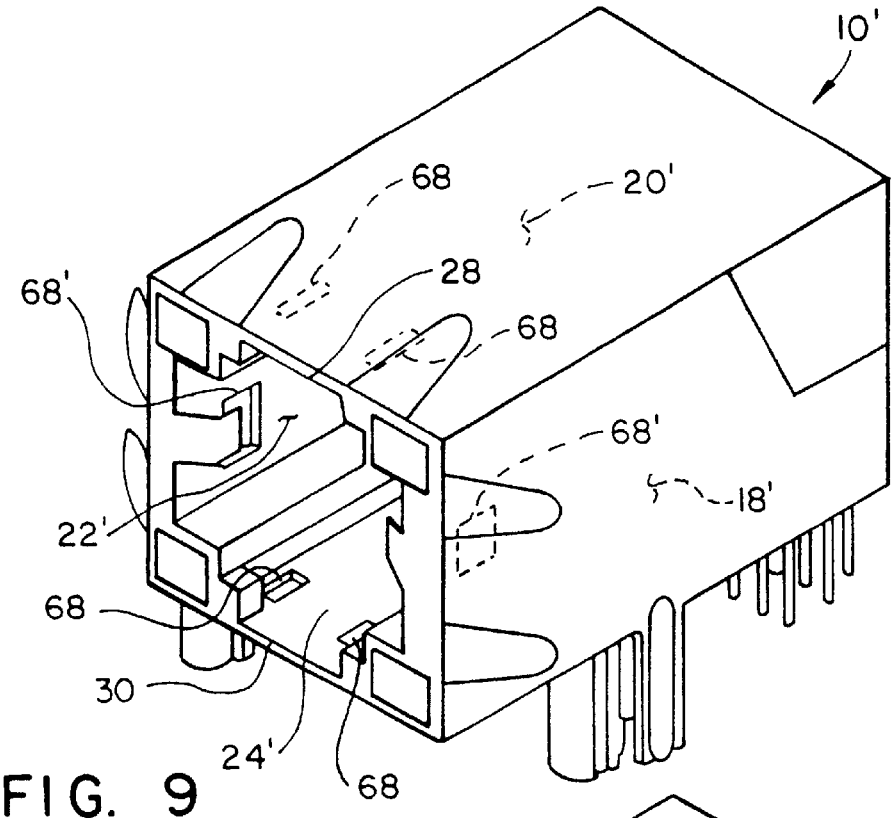
FIG. 9 is a perspective view of a second embodiment female housing according to the present invention.
Figure 14:
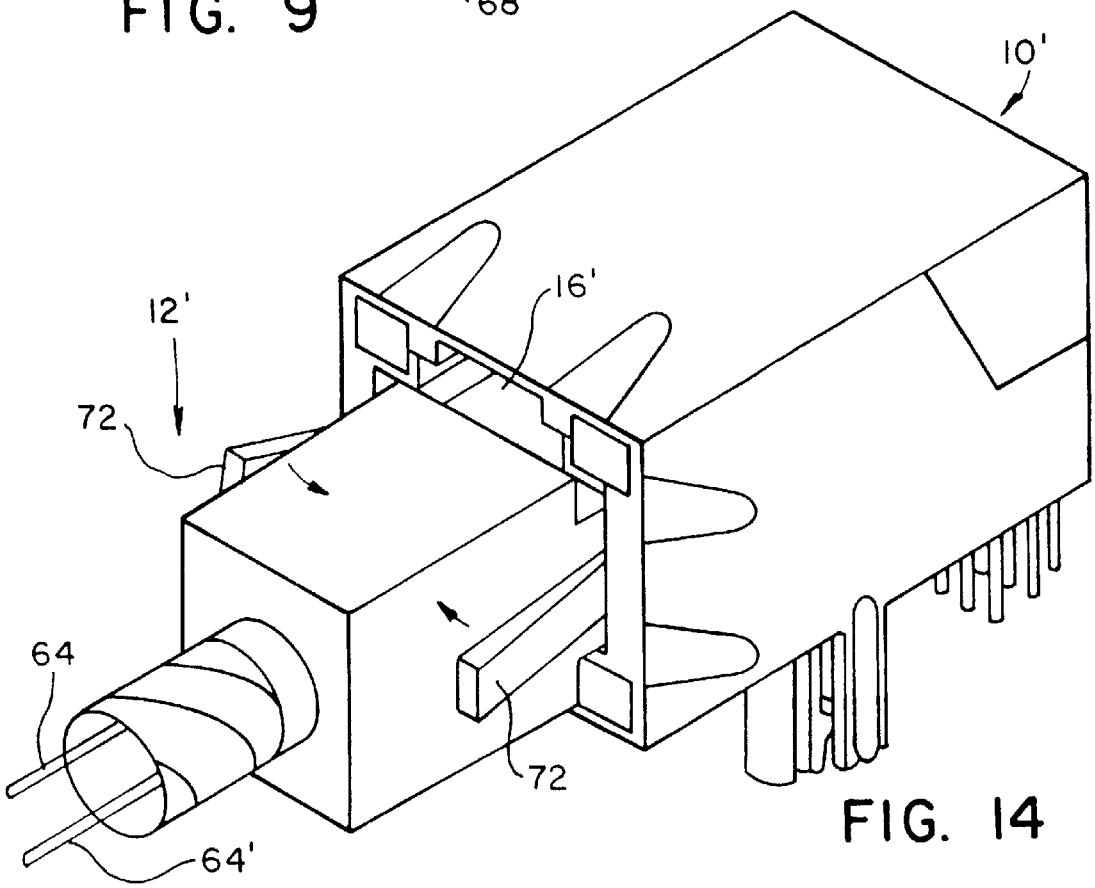
FIG. 14 is a perspective view of the female housing and male plug shown in FIG. 13 releasably connected together.
Figure 13:
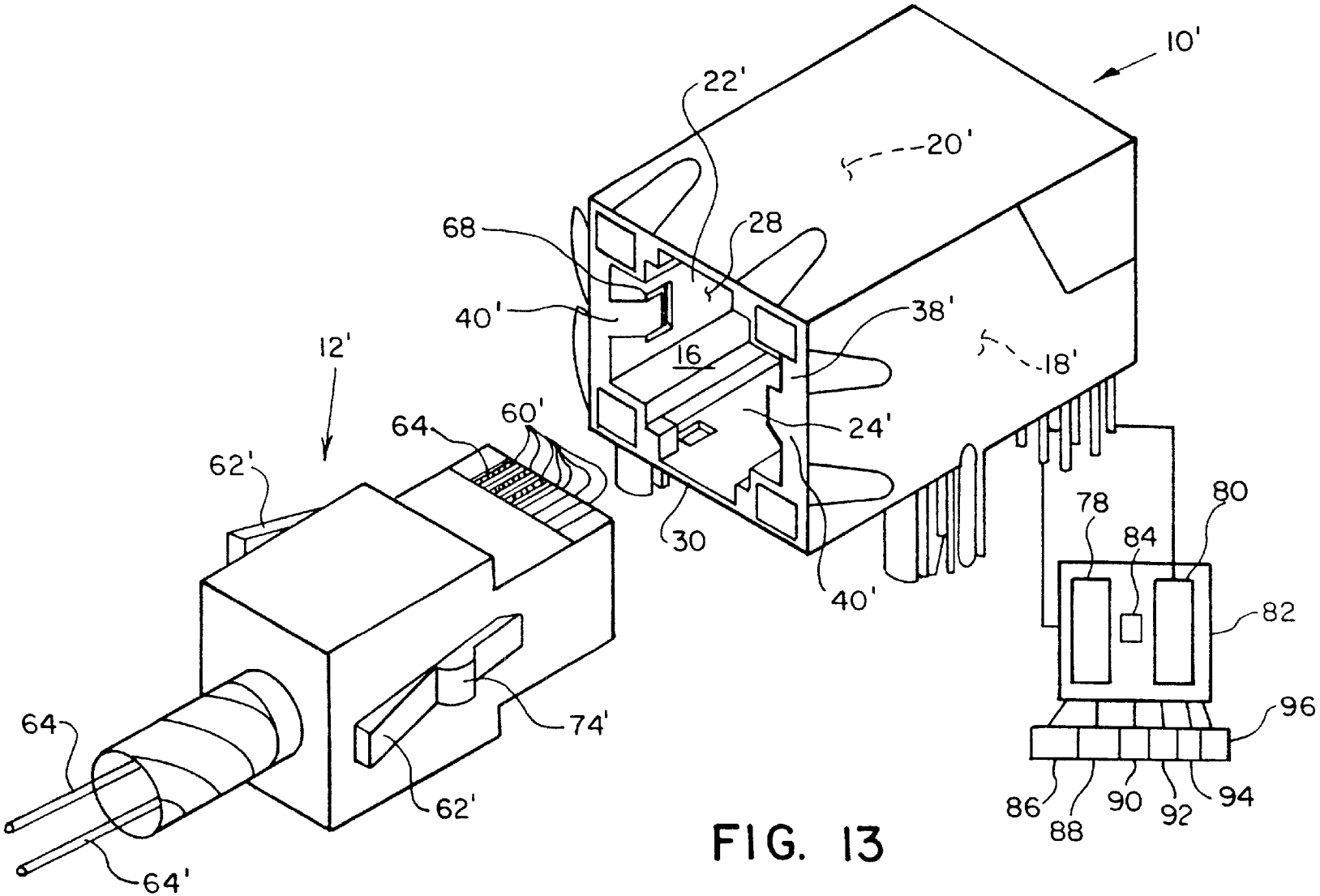
FIG. 13 is a perspective view of the female housing shown in FIG. 9 and the male plug shown in FIGS. 10–12.
Figure 15:
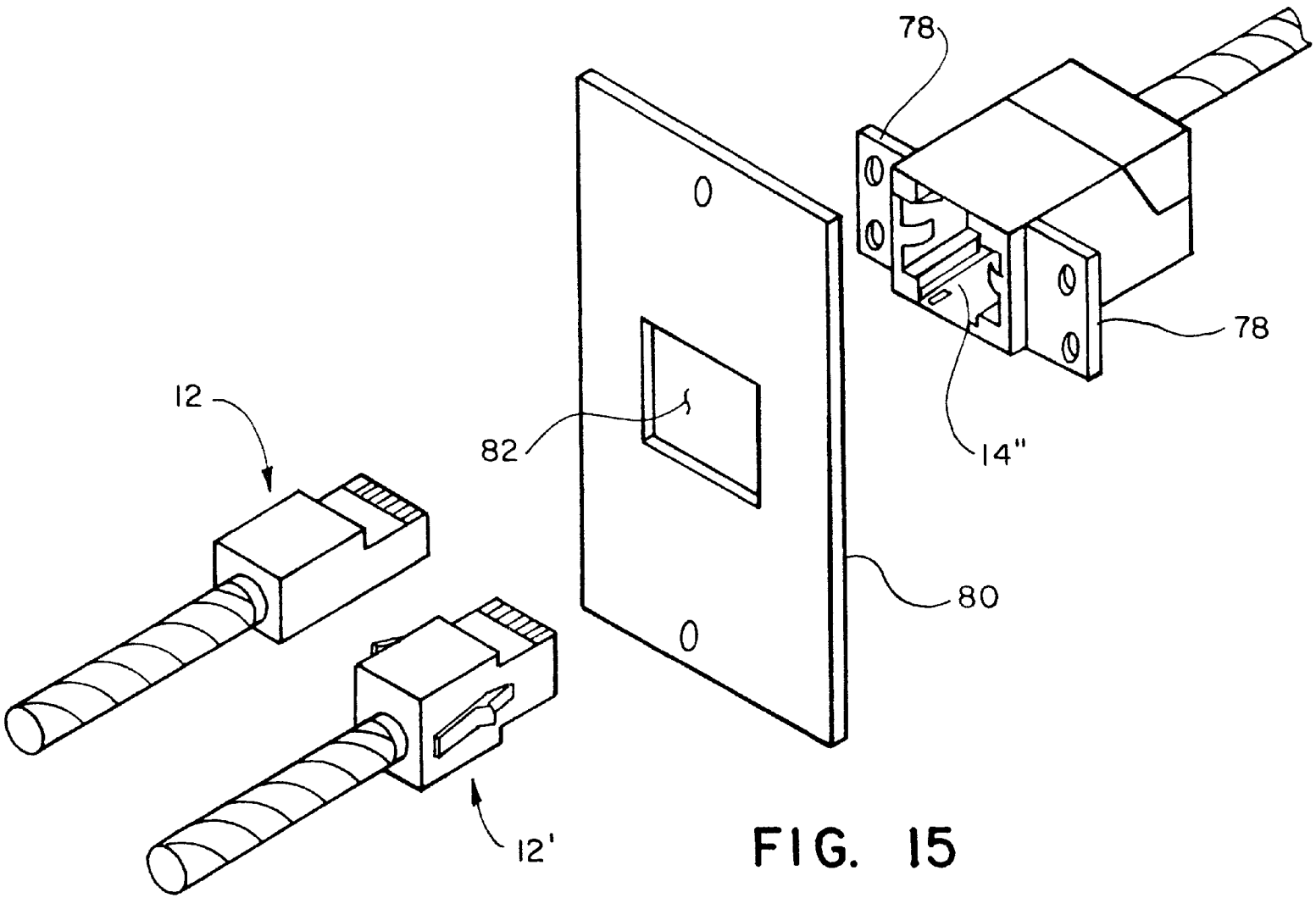
FIG. 15 is an exploded perspective view of a third embodiment female housing, a wall cover plate, and the first and second embodiment male plugs shown in FIGS. 6–8 and 10–14.

A first embodiment female housing 10 according to the present invention is shown in FIGS. 1–8. A first embodiment male plug 12 according to the present invention is shown in FIGS. 6–8. A second embodiment female housing 10' is shown in FIGS. 9 and 13–14. A second embodiment male plug 12' is shown in FIGS. 10–14. A third embodiment female housing 10" is shown in FIG. 15. For the purposes of this description, the female housing and the male plug are of the RJ-type. However, other types of multi-purpose modular connectors may also fall within the scope and spirit of the present invention.

Figure 1:
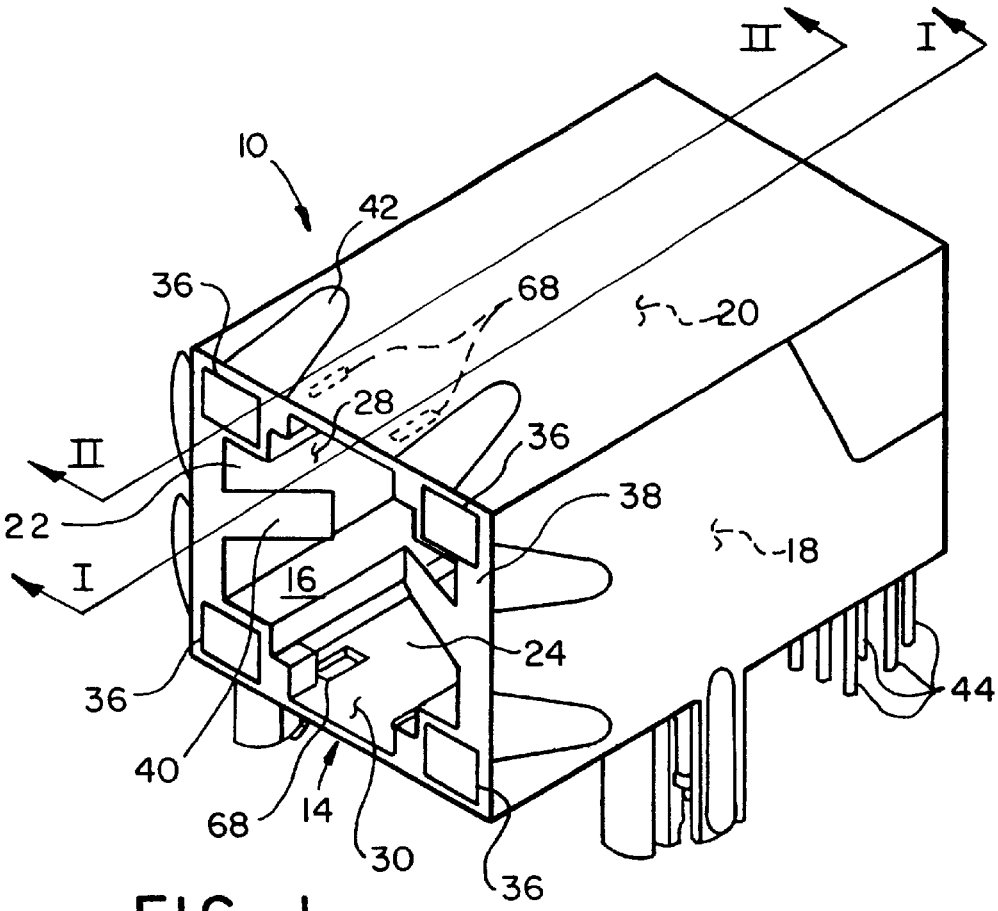
FIG. 1 is a perspective view of a first embodiment female housing according to the present invention.
Figure 2:
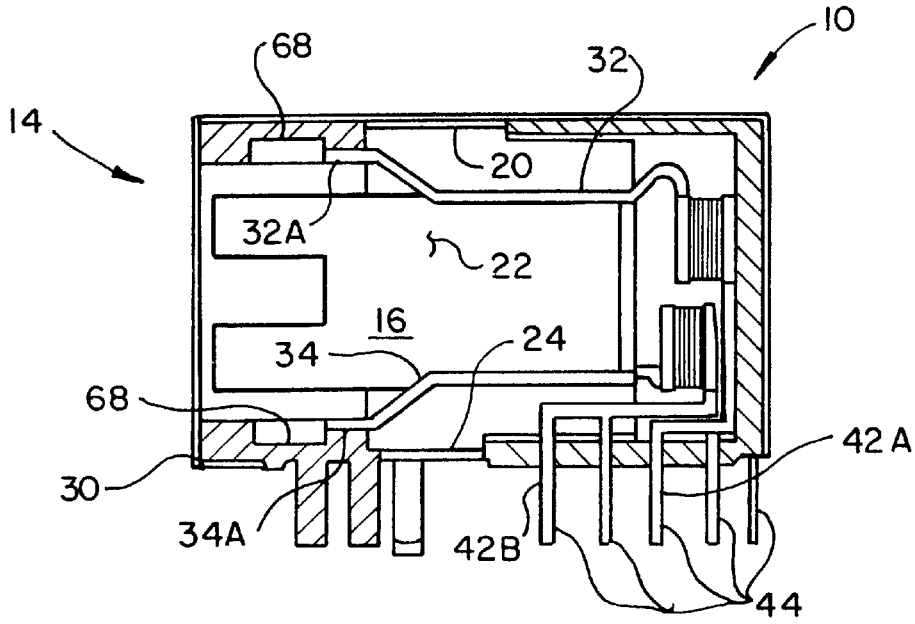
FIG. 2 is a cross-sectional side view of the female housing shown in FIG. 1, taken along section line I—I.

Referring to FIGS. 1 and 2, the first embodiment female housing 10 is generally a hollow box-like structure defining an open end 14, a first internal cavity 16, four interior surfaces 18, 20, 22, 24, and an interior end surface 26. As shown in FIG. 1, separate latch grooves 28, 30 are preferably defined by two or more of the interior surfaces 18, 20, 22, 24, along with at least one latch divot 68, which is discussed below. It will be apparent to one skilled in the art, after reading this detailed description, that while four interior surfaces 18, 20, 22, 24 are preferred, only two or more internal surfaces are needed.

Figure 3:
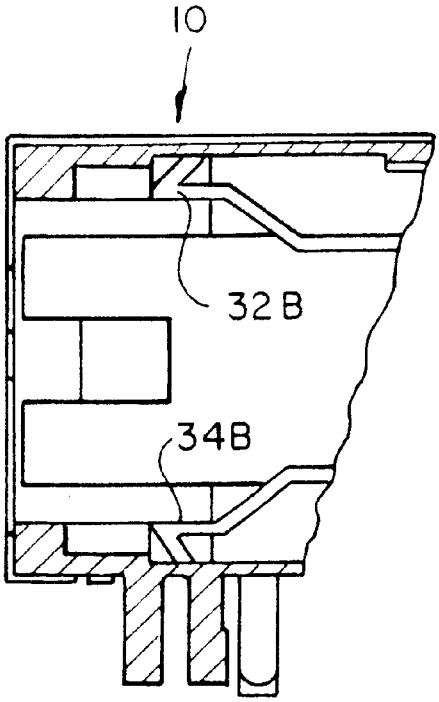
FIG. 3 is a partial cross-sectional side view of the female housing shown in FIG. 1, taken along section line I—I.

Referring again to FIG. 2, at least one first contact terminal 32 is positioned adjacent to one of the four interior surfaces 18, 20, 22, 24, preferably opposite to an interior surface defining a latch groove 28, 30. For the purposes of illustration only, FIG. 2 shows a first contact terminal 32 positioned adjacent to interior surface 20. A second contact terminal 34 is positioned adjacent to another of the interior surfaces 18, 20, 22, 24, again preferably opposite to an interior surface defining a latch groove 28, 30. FIG. 2 shows flattened, spring-type contact terminals 32A, 34A for longer male plug travel and less spring back. FIG. 3 shows right angle, spring-type contact terminals 32B, 34B with medium travel and more moderate spring back. FIG. 4 shows C-bend, spring-type contact terminals 32C, 34C with little travel and greater spring back. It will be apparent to one skilled in the art that contact terminals currently are available in many sizes and shapes, and that the contact terminals 32, 34 discussed above are only examples of possible applications. Other suitable contact terminals 32, 34 may also be used.

As shown in FIGS. 1 and 5, light emitting diodes 36 are also preferably positioned adjacent to the female housing 10, and are preferably incorporated directly into the female housing 10.

As shown in FIGS. 1 and 6–8, a first embodiment male connector harness 38, which defmes at least one flexible tab 40, is positioned adjacent to the open end 14 of the female housing 10, along with shielding 42. One advantage of the first embodiment male connector harness 38 is that it compensates for differently-sized male plugs. For example, an RJ45 male plug typically having eight wires is generally wider than an RJ11 male plug typically having four wires, so a female housing 10 configured with four first contact terminals 32 and eight second contact terminals 34 should be sized to accept an RJ45-sized male plug. However, if the female housing 10 is sized for an RJ45 male plug, an RJ11 male plug having a width smaller than the RJ45 male plug would not properly fit the female housing 10. The male connector harness 38 helps to alleviate this problem via the flexible tabs 40. When a male plug 12 having a width substantially equal to the first internal cavity 16 defined by the female housing 10 is inserted into the open end 14 of the female housing 10, the flexible tabs 40 are pressed in a direction toward the interior surfaces 18, 20, 22, 24 of the female housing 10. However, when a male plug 12 having a smaller width is inserted into the first internal cavity 16 defined by the female housing 10, the flexible tabs help to apply a force to exterior surfaces of the male plug 12 and hold the male plug 12 in place.

Referring to FIGS. 1–2 and 5, a plurality of leads 44 may extend away from the female housing 10. FIG. 2 shows a lead 42A electrically connected to the first contact terminal 32, and another lead 42B electrically connected to the second contact terminal 34. FIG. 5 shows leads 42C, 42D electrically connected to a corresponding LED 36. Any of the leads 44 may be further connected to one another or to some other object, such as a printed circuit board, such as by surface mounting, thru hole mounting, ball grind array, or other suitable method. Moreover, more than one female housing 10 can be stacked or bundled together in multiple ports.

Referring generally to FIGS. 6–8, the first internal cavity 16 defined by the female housing 10 receives a first embodiment male plug 12. As shown in FIG. 6, the male plug 12 is generally box-shaped and defines four external surfaces 46, 48, 50, 52, a second open end 54, a second closed end 56, and a second internal cavity 58. As shown in FIG. 6, one of the external surfaces 46, 48, 50, 52 defines one or more partitioned wire grooves 60, with four, six, or eight partitioned wire grooves 60 being preferred. A collapsible wire holder (not shown) may be defined by one or more of the external surfaces 46, 48, 50, 52, and at least one flexible latch 62 may be positioned adjacent to one or more of the external surfaces 46, 48, 50, 52, with the flexible latch 62 preferably defining at least one ridge 74 which releasably engages a latch divot 68 defined by the first embodiment female housing 10 to help hold the first embodiment male plug 12 in place. The flexible latch 62 is preferably positioned opposite to an external surface 46, 48, 50, 52 defining the one or more partitioned wire grooves 60.

The male plug 12 may be an RJ11-type of male plug, an RJ45-type of male plug, or other type of male plug. As shown in FIGS. 6–8, a single wire or a plurality of wires 64 is inserted into the second open end 54 defined by the male plug 12 and strung through the second internal cavity 58 defined by the male plug 12. A corresponding end 66 of each wire or wires 64 is positioned in a corresponding one of the plurality of partitioned wire grooves 60, thus electrically insulating the wires from one another. The collapsible wire holder (not shown) is then compressed to hold the wire or wires 64 securely within the male plug 12.

One method of operation of a modular connector that includes the first embodiment female housing 10 according to the present invention and the first embodiment male plug 12 according to the present invention is shown in FIGS. 6–8. The first step, as shown in FIG. 6, generally includes the step of orienting the male plug 12 in a first orientation with respect the female housing 10, so that the flexible latch 62 lines up with a corresponding latch groove 28, 30. In this example, the flexible latch 62 is lined up with the latch groove indicated by reference numeral 30. As shown in FIG. 7, the next step is inserting the male plug 12 into the open end 14 of female housing 10. The flexible latch 62 releasably seats in the corresponding latch groove 30 and at least one ridge 74, shown in FIG. 6, preferably releasably seats in the latch divot 68 defined by the female housing 10. Referring again to FIG. 7, in this first orientation, at least one corresponding end 66 of one of the plurality of individual wires 64 positioned in a partitioned wire groove 60 in the male plug 12 (FIG. 6) contacts a corresponding first contact terminal 32 (FIG. 2). As shown in FIG. 6, other steps include withdrawing the male plug 12 from the female housing 10 in the direction indicated by arrow Al and orienting the male plug 12 or a different male plug in a second orientation with respect to the female housing 10. A second orientation may be achieved by rotation of the male plug 12 about longitudinal axis L in the direction of either arrow A2 or A3. As shown in FIG. 8, the male plug 12, or another male plug having more wires 64 or fewer wires than the first embodiment male plug 12, can be inserted into the open end 14 of the female housing 10. In this second orientation, at least one corresponding end 66 of one of the plurality of wires 64 positioned in a partitioned wire groove 60 in the male plug 12 (FIG. 6) contacts a corresponding second contact terminal 34 (FIG. 2). This dual functionality of the female housing 10 allows for the connectivity of one common function or two distinct functions.

A second embodiment female housing 10' is shown in FIGS. 9 and 13–14. The second embodiment female housing 10' is similar to the first embodiment female housing 10, with like reference numerals indicating like parts. However, in the second embodiment female housing 10', internal surfaces 18', 20', 22', 24' may or may not each define a latch groove 28, 30 but do preferably define additional latch divots 68'.

Figure 10:
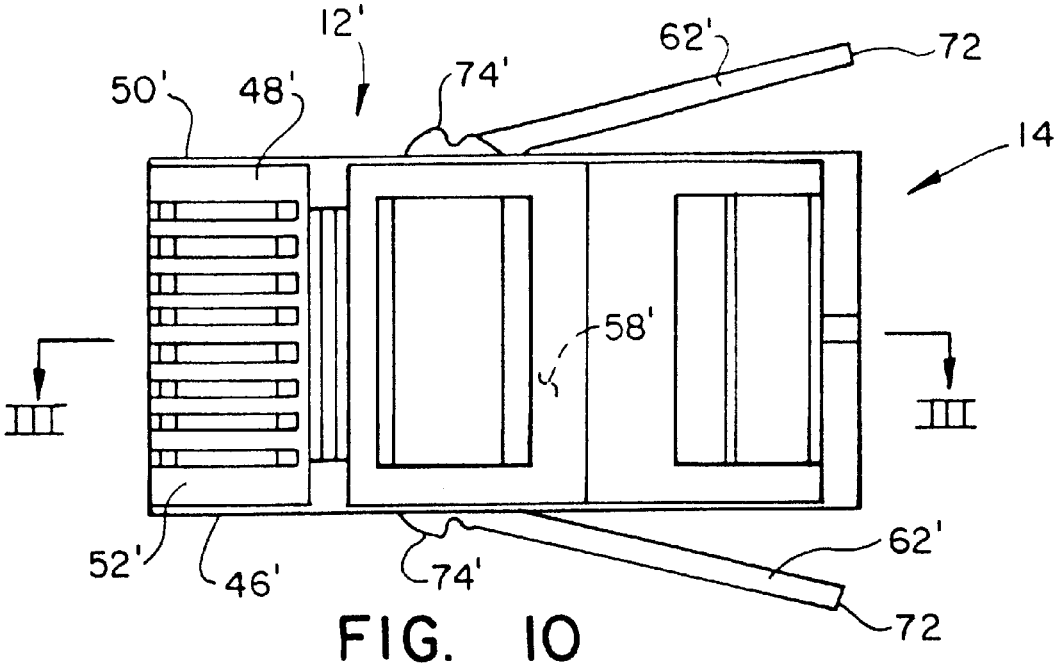
FIG. 10 is a top view of a second embodiment male plug according to the present invention.
Figure 11:
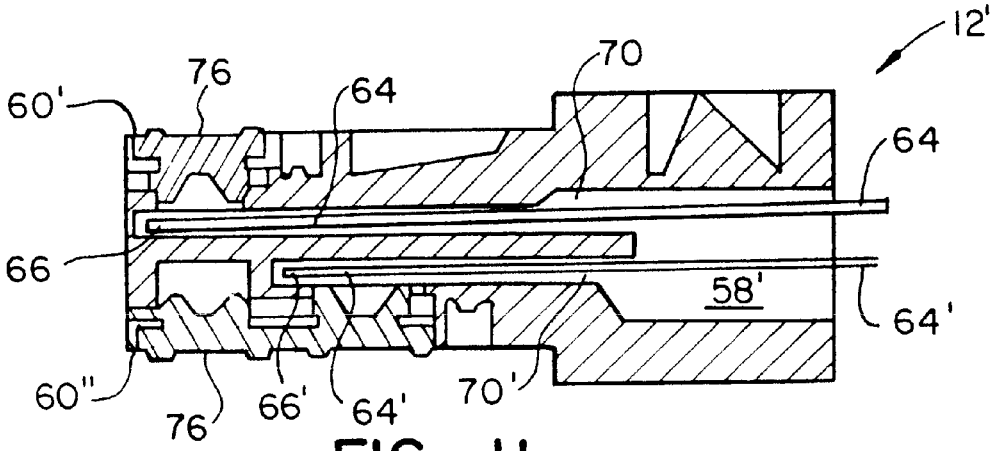
FIG. 11 is a cross-sectional side view of the male plug shown in FIG. 10, taken along section line III—III.
Figure 12:
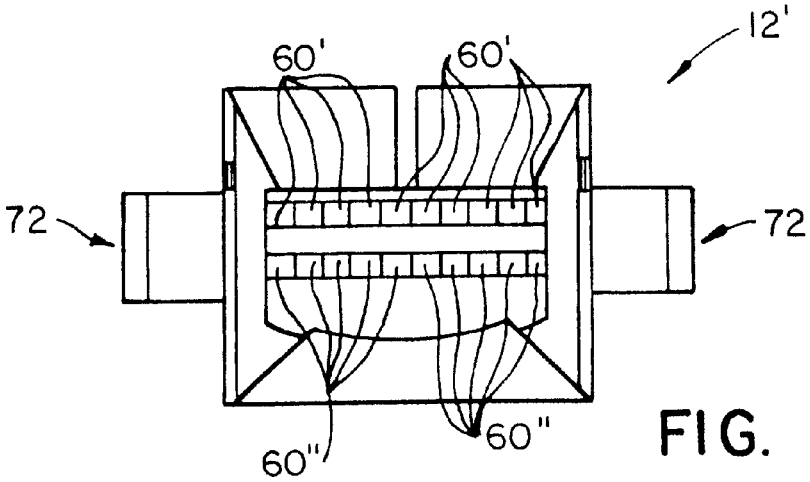
FIG. 12 is an end view of the male plug shown in FIG. 10.

A second embodiment male plug 12' is shown in FIGS. 10–14. As shown in FIGS. 10–14, the second embodiment male plug 12' is similar to the first embodiment male plug 12, with like reference numerals indicating like parts. As shown in FIGS. 10–11, the second embodiment male plug 12' is generally box-shaped and defines an open end 14', external surfaces 46', 48', 50', 52' and a second internal cavity 58'. As shown in FIG. 11, the second embodiment male plug 12' further defines one or more wire cavities 70, 70' for receiving a plurality of wires 64, as well as flexible latches 62'. The flexible latches 62' each form arms 72 and a ridge 74', with the ridge 74' releasably engaging a corresponding flexible tab 40' and a corresponding latch divot 68' defined by the second embodiment female housing 10'.

One difference between the second embodiment male plug 12' and the first embodiment male plug 12 is that two or more of the external surfaces 46', 48', 50', 52' define two sets of partitioned wire grooves 60', 60". Terminal tabs 76 may be individually positioned in a corresponding partitioned wire groove 60'. The second embodiment male plug 12' may be an RJ11-type of male plug, an RJ45-type of male plug, or other type of male plug.

As further shown in FIG. 11, the second embodiment male plug 12' receives two wires, two sets of plurality of wires 64, or any combination. It has been found that by having wire cavities 70, 70' which have differing lengths, as shown in FIG. 11, two or more wires or plurality of wires 64, 64' can be housed in the male plug with adequate shielding. A corresponding end 66 of one of the two wires or one of the plurality of wires 64 is positioned adjacent to a corresponding one of one set of partitioned wire grooves 60'. A corresponding end 66' of the other wire or one of the plurality of individual wires 64' is positioned adjacent to a corresponding one of the other set of partitioned wire grooves 60".

As shown in FIGS. 13–14, the second embodiment male plug 12' is inserted into the first internal cavity 16' defined by the second embodiment female housing 10', and can also be rotated into different orientations. As shown in FIG. 13, rotation of the second embodiment male plug 12' is not generally required if one of the wires or sets of wires 64 is connected to a first function 78 and the other wire or sets of wires 64' is connected to a second function 80. Another difference is that in the second embodiment male plug 12', each of the flexible tabs 40' defined by the male connector harness 38' and preferably each of the latch divots 68' defined by the second embodiment female housing 10' engage a corresponding ridge 74' once the second embodiment male plug 12' is seated in the second embodiment female housing 10'. To release the second embodiment male plug 12' from the second embodiment female housing 10', the arms 72 are moved in a direction toward the male plug 12' until each ridge 74' unseats from the corresponding latch divot 68' and clears a corresponding flexible tab 40'. The first embodiment male plug 12 may also be used in conjunction with the second embodiment female housing 10'.

A third embodiment female housing 10" is shown in FIG. 15. The third embodiment female housing 10" is similar to the second embodiment female housing 10', with like reference numerals indicating like parts. However, as shown in FIG. 15, the third embodiment female housing 10" defines wall brackets 78 designed to be mounted to a wall, electrical box, or other suitable device in a manner known to those skilled in the art. The wall brackets 78 may then be covered by a cover plate 80 defining an opening 82 corresponding to the open end 14" in the female housing for aesthetic purposes. As with the second embodiment female housing 10', the third embodiment female housing 10" may also be used in conjunction with either the first or the second embodiment male plugs 12, 12'.

The embodiments of the present invention described above help to provide an RJ-type modular connector which is extremely flexible. Instead of providing two separate female housings and two separate male plugs (one set for telecommunications and one set for LAN connectivity) the present invention allows one female housing and one male plug to be used for both purposes. For example, shown in FIG. 13 is a female housing 10' electrically connected to a printed circuit board in an electronic device, such as a motherboard 82 in a computer. The motherboard 82 generally includes a logic processor 84, and the computer may further include a fixed magnetic hard drive 86, a removable magnetic hard drive 88, a floppy hard drive 90, a CD-ROM 92, a visual monitor 94, and a printer 96. Four first terminals 32 can be electrically connected to the electronic components on the motherboard which support the first function 78, such as the telecommunications function. For LAN connectivity, eight second terminals 34 can be electrically connected to electronic components supporting the second function 80, such as LAN function. However, any number and type of first and second terminals 32, 34 can be used depending on the particular application.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A multi-functional RJ-type modular connector comprising:

an RJ-type female housing configured to receive an RJ-type male plug, the RJ-type female housing having an open, plug receiving end and at least two non-coplanar interior surfaces;

a first RJ-type contact terminal configuration positioned along one of the interior surfaces; and a second RJ-type contact terminal configuration positioned along another one of the interior surfaces, the second RJ-type contact terminal configuration having a different configuration than the first RJ-type contact terminal configuration, whereby the first and second contact terminal configurations are adapted to selectively mate with the RJ-type male plug when the plug is oriented with respect to the first and second contact terminals.

2. The multi-functional RJ-type modular connector as claimed in claim 1, further comprising an RJ-type male plug received by the RJ-type female housing, the RJ-type male plug selected from the group consisting of RJ11 and RJ45.

3. The multi-functional RJ-type modular connector as claimed in claim 1, wherein the first contact terminal is connected to a first function and the second contact terminal is connected to a second function.

4. The multi-functional RJ-type modular connector as claimed in claim 1, wherein the first contact terminal is selected from the group comprising a flattened spring-type contact terminal, a right angle spring-type contact terminal, and a C-bend spring-type contact terminal.

5. The multi-purpose modular connector as claimed in claim 1, further including at least one light emitting diode associated with the RJ-type female housing.

6. The multi-purpose modular connector as claimed in claim 5, wherein the light emitting diode is incorporated directly into the female housing.

7. The multi-purpose modular connector as claimed in claim 1, further comprising a plurality of leads which extend away from the female housing.

8. The multi-purpose modular connector as claimed in claim 7, wherein one of the plurality of leads is electrically connected to the first contact terminal and another of the plurality of leads is electrically connected to the second contact terminal.

9. The multi-purpose modular connector as claimed in claim 7, further comprising a first light emitting diode and a second light emitting diode, wherein one of the plurality of leads is electrically connected to the first light emitting diode and another of the plurality of leads is connected to the second light emitting diode.

10. The multi-purpose modular connector as claimed in claim 7, wherein the leads are further connected to a printed circuit board by a method selected from the group consisting of surface mounting, thru hole mounting, and ball grind array.

11. The multi-purpose modular connector as claimed in claim 1, further comprising means to accommodate at least two RJ-type male plugs having different widths.

12. The multi-purpose modular connector as claimed in claim 11, wherein the means to accommodate the RJ-type male plugs having different widths comprises a male connector harness conveying at least one flexible tab, wherein the male connector harness is positioned adjacent to the open end of the RJ-type female housing.

13. The multi-purpose modular connector as claimed in claim 1, further comprising an RJ-type male plug which has at least two external surfaces, wherein at least one of the at least two external surfaces defines one or more partitioned wire grooves.

14. The multi-purpose modular connector as claimed in claim 13, further comprising means for releasably locking the RJ-type male plug in the RJ-type female housing.

15. The multi-functional RJ-type modular connector as claimed in claim 14, wherein the means for releasably locking the RJ-type male plug in the RJ-type female housing comprises a latch groove defined by at least one of the at least two interior surfaces of the RJ-type female housing, a latch divot defined by at least one of the at least two interior surfaces of the RJ-type female housing, and a ridge on the flexible latch positioned adjacent to the RJ-type male plug, wherein the ridge releasably engages the latch divot.

16. A method to releasably connect an RJ-type male plug to an RJ-type female housing, the RJ-type male plug having at least two non-coplanar external surfaces, wherein one of the at least two external surfaces defines one or more partitioned wire grooves which each individually receive a corresponding one of a plurality of wires, and the RJ-type female housing having an open end, another two non-coplanar interior surfaces, a first contact terminal positioned along at least one of the at least two interior surfaces, and a second contact terminal positioned along at least one of the at least two interior surfaces, comprising the steps of:

a. orienting the RJ-type male plug in a first orientation with respect to the RJ-type female housing;

b. inserting the RJ-type male plug into the open end of the RJ-type female housing;

c. withdrawing the RJ-type male plug from the RJ-type female housing;

d. orienting the RJ-type male plug in a second orientation with respect to the RJ-type female housing; and e. inserting the RJ-type male plug into the open end of the RJ-type female housing, wherein in the first orientation, at least one of the plurality of individual wires electrically contacts a corresponding first contact terminal and in the second orientation, at least one of the plurality of wires electrically contacts a corresponding second contact terminal.

17. A multi-functional RJ-type modular connector system comprising:

an RJ-type female housing having an open end and at least two non-coplanar interior surfaces;

a first RJ-type contact terminal configuration positioned along one of the two interior surfaces;

a second RJ-type contact terminal configuration positioned along another of the interior surfaces; and an RJ-type male plug conveying a plurality of wires, the RJ-type male plug configured to be inserted into the open end of the RJ-type female housing;

wherein (i) when the RJ-type male plug is oriented in a first orientation and inserted into the open end of the RJ-type female housing, at least one of the plurality of wires electrically contacts a corresponding first contact terminal in the first contact terminal configuration and (ii) when the RJ-type male plug is oriented in a second different orientation and inserted into the open end of the RJ-type female housing, at least one of the plurality of wires electrically contacts a corresponding contact terminal in the second contact terminal configuration.

18. The multi-functional RJ-type modular connector as claimed in claim 17, wherein the first contact terminal is connected to a first function and the second contact terminal is connected to a second function.

19. A multi-functional RJ-type modular connector comprising:

an RJ-type female housing having and open end and at least two non-coplanar interior surfaces;

a first RJ-type contact terminal configuration positioned along one of the interior surfaces;

a second RJ-type contact terminal configuration positioned along another one of the interior surfaces; and an RJ-type male plug having a first plurality of wires and a second plurality of wires, the RJ-type male plug configured to be inserted in the open end of the RJ-type female housing;

wherein when the RJ-type male plug is inserted into the open end of the RJ-type female housing, at least one first electrically contact terminal contacts a corresponding one of the first plurality of wires and at least one second electrically contact terminal contacts a corresponding one of the second plurality of wires, whereby electrical connection is selectively established between the first and second contact terminal configurations.

20. The multi-functional RJ-type modular connector as claimed in claim 19, wherein the at least one first contact terminal is connected to a first function and the at least one second contact terminal is connected to a second function.

21. An electronic device comprising:

a printed circuit board;

an RJ-type female housing configured to receive an RJ-type male plug, the RJ-type female housing having an open, plug receiving end and least two non-coplanar interior surfaces;

a first RJ contact terminal configuration positioned along one of the interior surfaces; and a second RJ contact terminal configuration positioned along another one of the interior surfaces the second RJ contact terminal configuration having a different configuration than the first RJ contact terminal configuration, whereby the first and second contact terminal configurations are adapted to selectively mate with the RJ-type male plug when the plug is oriented with respect to the first and second contact terminals.

22. The electronic device as claimed in claim 21, wherein the printed circuit board further comprises a logic processor.

23. The electronic device as claimed in claim 21, wherein the electronic device further comprises a component selected from the group consisting of a fixed magnetic hard drive, a removable magnetic hard drive, a floppy hard drive, a CD-ROM, a visual monitor, and a printer, wherein each component is electrically connected to the circuit board.

* * * * *

UNITED STATES PATENT AND TRADEMARK OFFICE

CERTIFICATE OF CORRECTION

PATENT NO. : 6,558,203 B2
DATED : May 6, 2003
INVENTOR(S) : Alan L. Pocrass

It is certified that error appears in the above-identified patent and that said Letters Patent is hereby corrected as shown below:

Title page, Item [54] and Column 1, line 1,
"MULTI-FUNCTION" should read -- MULTI-FUNCTIONAL --.

Title page,
Item [57], ABSTRACT,
Line 4, "surface a first" should read -- surface, a first --.

Column 3,
Line 50, "defmes" should read -- defines --.

Column 4,
Line 15, "grind" should read -- grid --.
Line 55, "respect the" should read -- respect to the --.

Column 7,
Lines 23, 26, 29, 32, 37, 43, 48, 51, 57 and 62, "multi-purpose modular" should read -- multi-functional RJ-type modular --.
Line 46, "grind" should read -- grid --.

Column 8,
Line 13, "another two" should read -- at least two --.
Line 16, "at least one" should read -- another one --.

Column 9,
Line 9, "first electrically contact terminal contacts" should read -- first contract terminal electrically contacts --.
Lines 11-12, "second electrically contact terminal contacts" should read -- second contact terminal electrically contacts --.

UNITED STATES PATENT AND TRADEMARK OFFICE

CERTIFICATE OF CORRECTION

PATENT NO. : 6,558,203 B2
DATED : May 6, 2003
INVENTOR(S) : Alan L. Pocrass

It is certified that error appears in the above-identified patent and that said Letters Patent is hereby corrected as shown below:

Column 10,
Line 1, "and least" should read -- and at least --.
Line 6, "surfaces" should read -- surfaces, --.

Signed and Sealed this

Twenty-fifth Day of November, 2003

JAMES E. ROGAN
*Director of the United States Patent and Trademark Office*